US005829799A

United States Patent [19]

Yamagishi et al.

[11] Patent Number: 5,829,799

[45] Date of Patent: Nov. 3, 1998

[54] AUTOMOTIVE LID LOCK DEVICE WITH POWER UNLOCKING MECHANISM

[75] Inventors: Jun Yamagishi; Yasuyuki Fukushima; Shigenori Taga, all of Yokohama; Yoshio Watanuki, Ebina; Takeharu Iwata, Fujisawa, all of Japan

[73] Assignees: Ohi Seisakusho Co., Ltd.; Nissan Motor Co., Ltd., both of Yokohama, Japan

[21] Appl. No.: 659,488

[22] Filed: Jun. 6, 1996

[30] Foreign Application Priority Data

Jun. 7, 1995 [JP] Japan ..... 7-140218

[51] Int. Cl.[6] ..... E05C 3/06

[52] U.S. Cl. ..... 292/201; 292/216; 292/DIG. 43; 403/164

[58] Field of Search ..... 292/216, 201, 292/DIG. 65, DIG. 43, 341.16, DIG. 25; 403/164

[56] References Cited

U.S. PATENT DOCUMENTS

| | | | |
|---|---|---|---|
| 3,113,447 | 12/1963 | Oishei | 292/DIG. 43 X |
| 3,170,722 | 2/1965 | Schutte | 292/DIG. 43 X |
| 3,504,511 | 4/1970 | Allen | 292/216 X |
| 3,917,330 | 11/1975 | Quantz | 292/216 |
| 4,037,978 | 7/1977 | Connelly | 403/164 |
| 4,579,473 | 4/1986 | Brugger | 403/164 |
| 4,616,862 | 10/1986 | Ward | 292/DIG. 27 X |
| 4,652,027 | 3/1987 | Quantz | 292/DIG. 43 X |
| 4,969,672 | 11/1990 | Childs et al. | 292/216 X |
| 4,971,370 | 11/1990 | Detweiler et al. | 292/DIG. 43 X |
| 4,979,384 | 12/1990 | Malesko et al. | 292/216 X |
| 5,000,495 | 3/1991 | Wolfgang et al. | 292/216 |
| 5,007,261 | 4/1991 | Quantz | 292/216 X |
| 5,020,838 | 6/1991 | Fukumoto | 292/216 X |

FOREIGN PATENT DOCUMENTS

| | | | |
|---|---|---|---|
| 1132024 | 6/1962 | Germany | 292/216 |
| 57-6072 | 1/1982 | Japan . | |
| 59-65165 | 5/1984 | Japan . | |

*Primary Examiner*—Rodney M. Lindsey
*Attorney, Agent, or Firm*—Foley & Lardner

[57] ABSTRACT

An automotive lid lock device comprises a lock proper which includes a latch plate and a locking plate. The locking plate is pivotal between a locking position to lock the latch plate and an unlocking position to release the latch plate. The lid lock device further comprises a power unlocking mechanism for pivoting the locking plate to the unlocking position with an aid of an electric power. The power unlocking mechanism includes an electric motor; a worm connected to an output shaft of the motor to rotate therewith; a worm wheel operatively engaged with the worm and a release lever extending between the locking plate and the worm wheel to pivot the locking plate from the locking position to the unlocking position when the worm wheel is turned in a given direction. The release lever, the locking plate and the worm wheel are so arranged that when the worm wheel is turned in the given direction, the worm wheel pushes the release lever toward the locking plate.

15 Claims, 8 Drawing Sheets

AUTOMOTIVE LID LOCK DEVICE WITH POWER UNLOCKING MECHANISM

BACKGROUND OF THE INVENTION

1. Field of the Invention

The present invention relates in general to automotive lid lock devices and more particularly to automotive lid lock devices of a type having a power unlocking mechanism by which a locked condition of the lock device can be canceled with an aid of an electric power.

2. Description of the Prior Art

In order to clarify the task of the present invention, two conventional automotive lid lock devices of the above-mentioned type will be briefly described in the following.

One lid lock device is the device disclosed in Japanese Utility Model First Provisional Publication 59-65165. This lid lock device is incorporated with a lid for an automotive trunk room and comprises generally a latch plate which latches a striker when assuming a latching position, a locking plate which locks the latch plate at the latching position when assuming a locking position, and an electromagnetically operated plunger which, when energized, pulls the locking plate from the locking position to release the striker from the latch plate. Thus, upon energization of the electromagnetic plunger, the trunk lid is permitted to open by hand.

The other lid lock device is the device disclosed in Japanese Patent First Provisional Publication 57-6072. This lid lock device is also incorporated with an automotive trunk lid and generally comprises a latch plate which latches a striker when assuming a latching position, a locking plate which locks the latch plate at the latching position when assuming a locking position, an electromagnetically operated plunger which, when energized, moves the locking plate from the locking position to release the striker from the latch plate. The lid lock device further comprises a so-called anti-theft mechanism which is arranged to open a drive circuit of the electromagnetic plunger when manipulated. The mechanism generally comprises a key cylinder mounted on the trunk lid, a rod installed inside of the trunk lid and rotatable with the key cylinder, an operation lever pivotally driven by the rod, and a switch member for opening the drive circuit of the electromagnetic plunger when actuated by the operation lever. That is, when the key cylinder is turned by a key from the outside of the vehicle, the operation lever actuates the switch member to open the drive circuit. Under this condition, the locked condition of the trunk lid can not be canceled even when a lid open switch installed in the vehicle is manipulated by a thief who has illegally entered the vehicle.

However, due to inherent construction, the above-mentioned two conventional lid lock devices have the following drawbacks.

That is, in the lock device of the publication 59-65165, the plunger is arranged on a forward part of a way along which the locking plate travels and constructed to pull the locking plate when releasing of the striker from the latch plate is carried out. Thus, the lock device becomes bulky in construction, more specifically, the size of the lock device in the traveling direction of the locking plate is increased.

In the lock device of the publication 57-6072, to operate the anti-theft mechanism, it is necessary to handle a key from the outside of the vehicle, which however increases the possibility of losing the key. Furthermore, the condition of the anti-theft mechanism can not be recognized from the outside of the vehicle even when the trunk lid is opened, which makes the reliability of the anti-theft operation of the mechanism poor.

SUMMARY OF THE INVENTION

It is therefore an object of the present invention to provide an automotive lid lock device of the above-mentioned type, which is constructed by taking drawbacks of the above-mentioned conventional lid lock devices into consideration.

According to a first aspect of the present invention, there is provided an automotive lid lock device which comprises a lock proper including a latch plate and a locking plate, the locking plate being pivotal between a locking position to lock the latch plate and an unlocking position to release the latch plate; and a power unlocking mechanism for pivoting the locking plate to the unlocking position with an aid of an electric power, the power unlocking mechanism including an electric motor; a worm connected to an output shaft of the motor to rotate therewith; a worm wheel operatively engaged with the worm and a release lever extending between the locking plate and the worm wheel to pivot the locking plate from the locking position to the unlocking position when the worm wheel is turned in a given direction, wherein the release lever, the locking plate and the worm wheel are so arranged that when the worm wheel is turned in the given direction, the worm wheel pushes the release lever toward the locking plate.

According to a second aspect of the present invention, there is provided a lid lock system for use in a motor vehicle. The lid lock system comprises a lock proper associated with the trunk lid, the lock proper being capable of locking the trunk lid in a closed position when operated, the lock proper including a latch plate and a locking plate, the locking plate being pivotal between a locking position to lock the latch plate and an unlocking position to release the latch plate; a power unlocking mechanism mounted to the lock proper for pivoting the locking plate to the unlocking position with an aid of an electric power, the power unlocking mechanism including an electric motor, a worm connected to an output shaft of the motor, a worm wheel operatively engaged with the worm and a release lever extending between the locking plate and the worm wheel to pivot the locking plate from the locking position to the unlocking position when the worm wheel is turned in a given direction; a drive circuit for energizing the motor thereby to turn the worm wheel in the given direction when connected to a power source; a lid open switch installed in the motor vehicle, the lid open switch connecting the drive circuit and the power source when manipulated; and a cancel switch device mounted to the power unlocking mechanism for indisposing the lid open switch when manipulated.

According to a third aspect of the present invention, there is provided a lid lock system for use in a motor vehicle having a vehicle cabin and a trunk room which has a trunk lid pivotally connected thereto. The lid lock system comprises lid lock means for locking the trunk lid in a closing position; lid unlock means for canceling the locked condition of the trunk lid when electrically actuated; a lid open switch installed in the vehicle cabin for electrically actuating the lid unlock means when manipulated; and a cancel switch connected to the vehicle at a position which is inaccessible when the trunk lid is in the closing position, the cancel switch indisposing the lid open switch from electrically actuating the lid unlock means when manipulated.

SUMMARY OF THE DRAWINGS

Other objects and advantages of the present invention will become apparent from the following description when taken in conjunction with the accompanying drawings, in which.

DETAILED DESCRIPTION OF THE EMBODIMENTS

Referring to FIGS. 1 to 10 of the drawings, there is shown an automotive lid lock device 10A of a first embodiment of the present invention.

Figure 2:
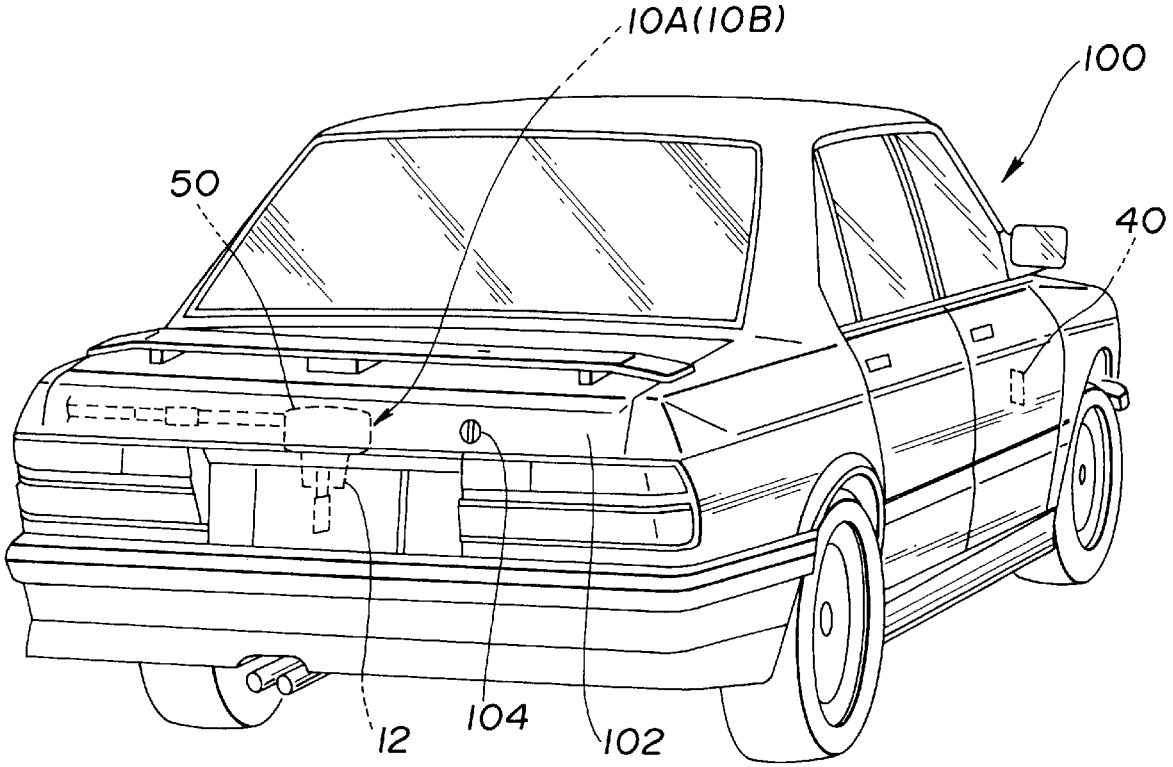
FIG. 2 is a rear view of a passenger motor vehicle to which the lid lock device of the first embodiment is practically applied.

As is seen from FIG. 2, the lid lock device 10A is mounted on a pivotal rear trunk lid 102 of a passenger motor vehicle 100 for locking the lid 102 to a rear trunk room of the vehicle 100. For effecting the locking, a striker (not shown) is mounted to the rear part of the vehicle 100. As will become apparent as the description proceeds, the lid lock device 10A has a power unlocking mechanism 50 incorporated therewith, which cancels a locked condition of the lock device 10A when a lid open switch 40 installed in the vehicle 100 is manipulated.

Figure 3:
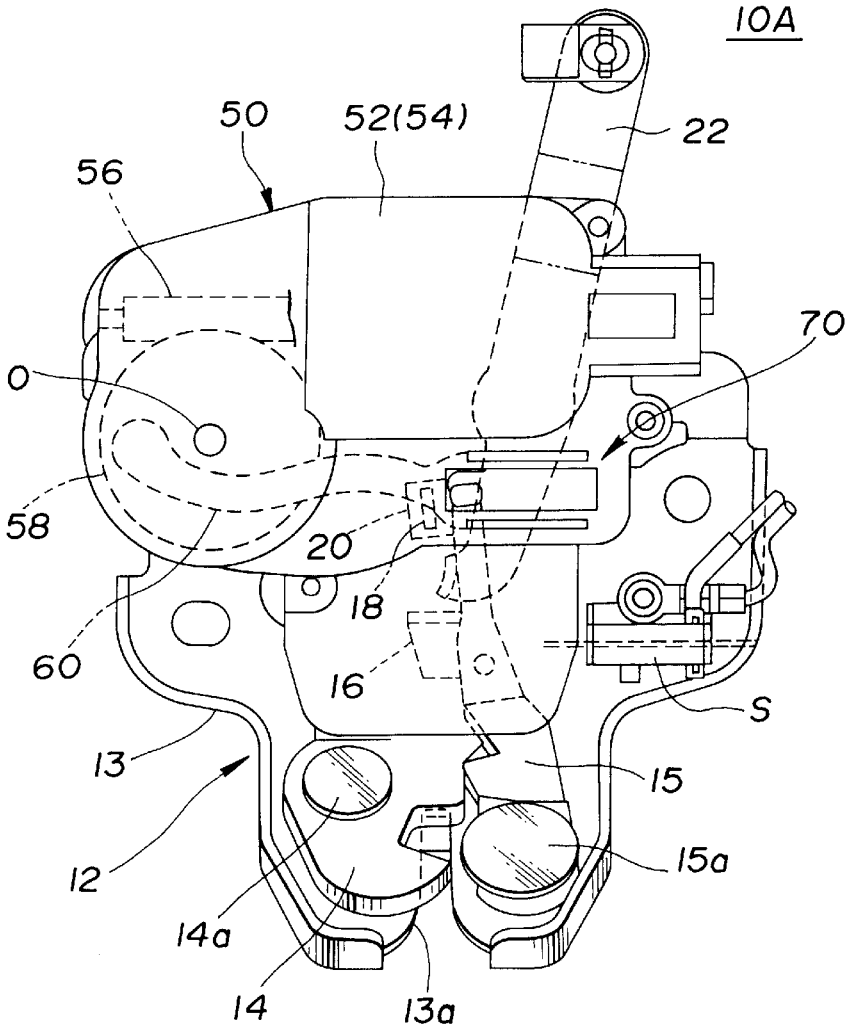
FIG. 3 is a front view of the lid lock device of the first embodiment with some parts removed.

As is seen from FIG. 3, the lid lock device 10A generally comprises a lock proper 12 and the power unlocking mechanism 50.

The lock proper 12 comprises a base plate 13 secured to the trunk lid 102. The base plate 13 is formed with a striker receiving recess 13*a* into which the striker is insertable upon closing of the trunk lid 102. A latch plate 14 and a locking plate 15 are pivotally connected through respective pins 14*a* and 15*a* to the base plate 13. These two plates 14 and 15 are arranged at opposite positions with respect to the striker receiving recess 13*a*, as shown. The latch plate 14 is pivotal between a latching position to latch the striker and an unlatching position to release the striker, while the locking plate 15 is pivotal between a locking position to lock the latch plate 14 at the latching position and an unlocking position to release the latch plate 14.

Figure 10:
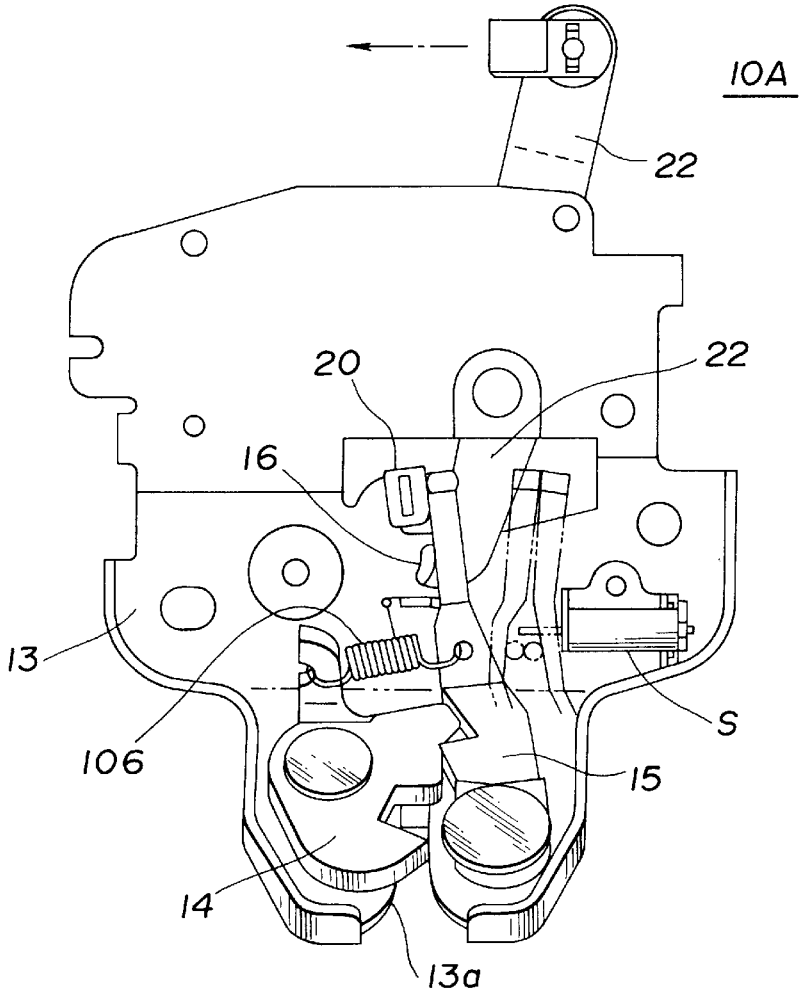
FIG. 10 is a front view of a lid lock device of the first embodiment with some parts removed therefrom.

As is seen from FIG. 10, a coil spring 106 extends between the latch plate 14 and the locking plate 15. Due to a biasing force produced by the spring 106, the latch plate 14 is biased to pivot toward the unlatching position and the locking plate 15 is biased to pivot toward the locking position.

The lock proper 12 is formed with first and second stoppers 16 and 18 against which an upwardly extending part of the locking plate 15 abuts when pivoting counterclockwise in FIG. 3, that is, toward the locking position. The second stopper 18 is equipped with a shock absorber 20 of a rubber material. Before assuming the locking position, the locking plate 15 is brought into abutment with the shock absorber 20. That is, under pivoting toward the locking position, the upwardly extending part of the locking plate 15 abuts on the shock absorber 20 and then abuts on the first stopper 16. Thus, excessive counterclockwise pivoting of the locking plate 15 is softly stopped at the locking position without producing noises.

The lock proper 12 is equipped with a pivotal canceling arm 22 which has a lower part operatively engaged with the upwardly extending part of the locking plate 15. Although not shown in the drawings, a link mechanism extends from the canceling arm 22 to a key cylinder 104 (see FIG. 2) which is disposed on the trunk lid 102. That is, when the key cylinder 104 is rotated in a given direction by a key from the outside of the vehicle, the canceling arm 22 forces the locking plate 15 to pivot from the locking position toward the unlocking position against the biasing force applied thereto.

Figure 6:
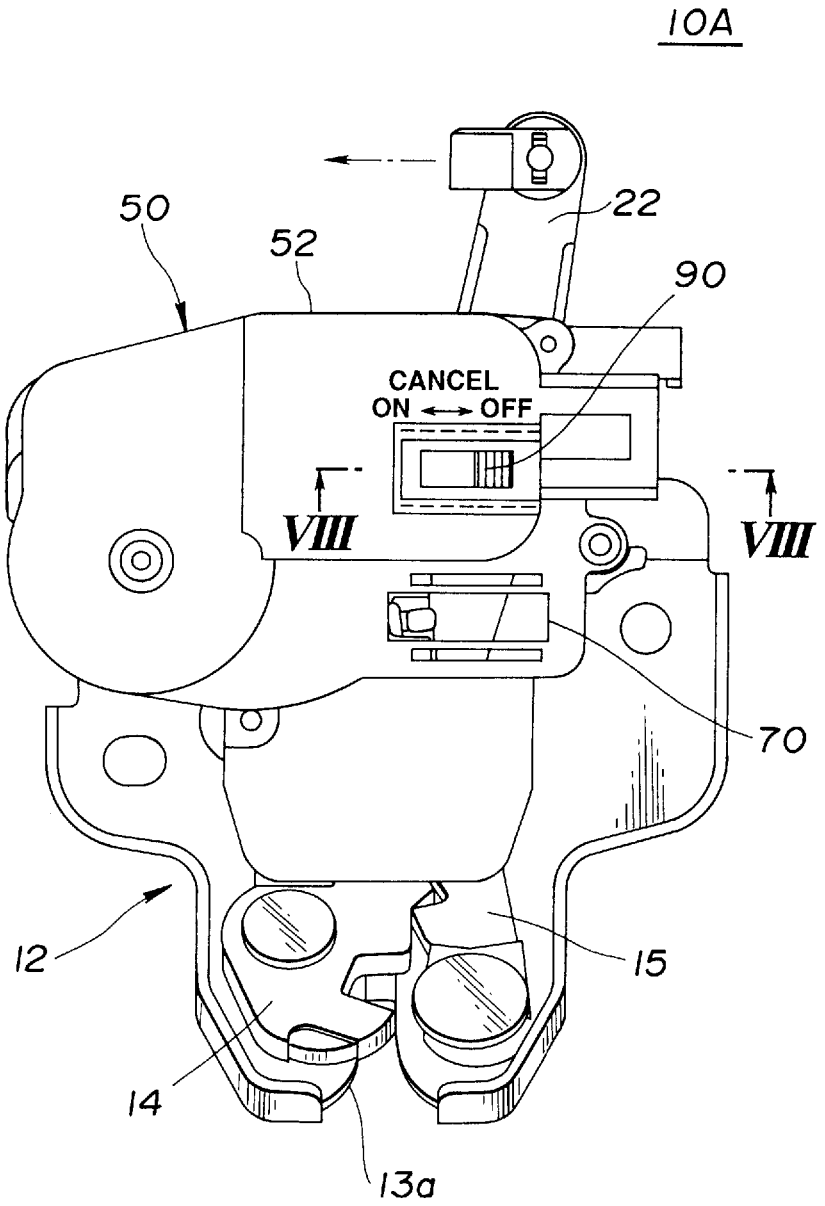
FIG. 6 is a view similar to FIG. 3, but showing a cancel switch device (or anti-theft device) mounted on the lid lock device.

As is well shown in FIGS. 3 and 6, the power unlocking mechanism 50 is mounted on an upper portion of the lock proper 12. As will become apparent as the description proceeds, the power unlocking mechanism 50 functions to pivot the locking plate 15 from the locking position to the unlocking position when the lid open switch 40 is manipulated.

Figure 1:
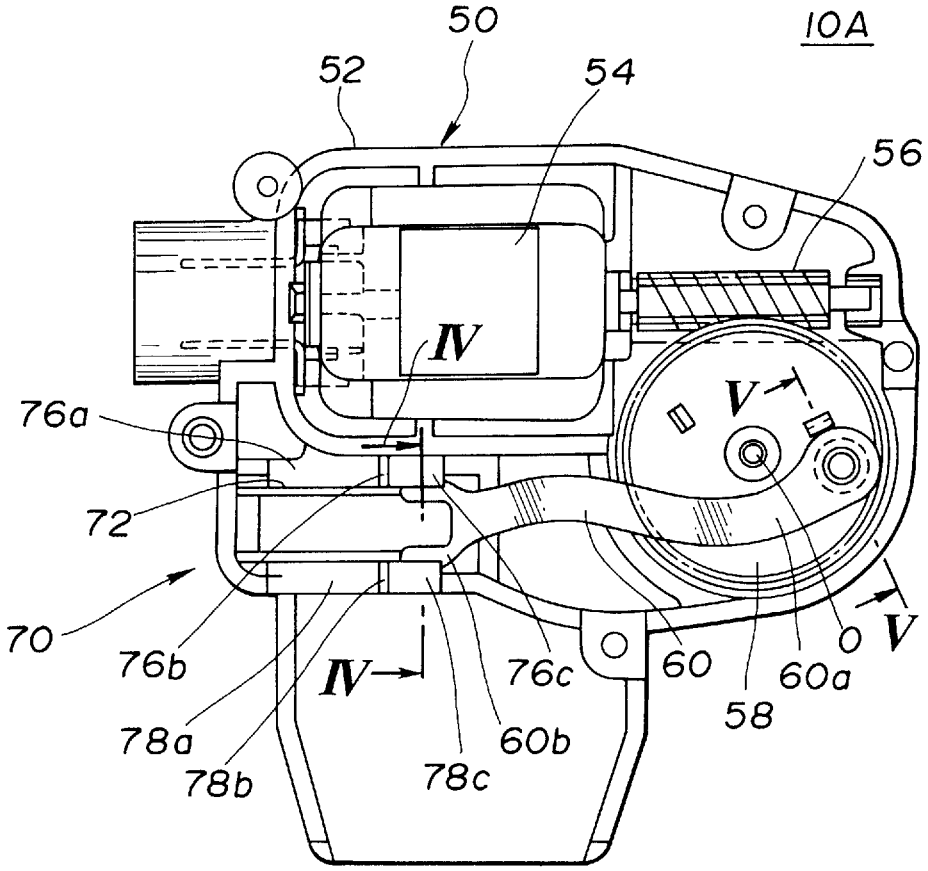
FIG. 1 is a back view of a power unlocking mechanism employed in an automotive lid lock device of a first embodiment of the present invention.

As is seen from FIG. 1, the power unlocking mechanism 50 comprises a casing 52 and an electric motor 54 which is mounted on the casing 52. A worm 56 is disposed on an output shaft of the motor 54 to rotate therewith, which is operatively engaged with a worm wheel 58. A release lever 60 is pivotally connected at one end to the worm wheel 58. When the motor 54 is energized to rotate the worm 56 and thus the worm wheel 58 in one or the other direction, the release lever 60 swings rightward or leftward in the drawing.

One end 60*a* of the release lever 60 is pivotally connected to a peripheral portion of the worm wheel 58, and the other end 60*b* of the release lever 60 is shaped like a fork.

The fork-shaped end 60*b* is in abutment with a bent head of the upwardly extending part of the locking plate 15 through an after-mentioned guide mechanism 70, so that when the release lever 60 is moved leftward in FIG. 1 (that is, rightward in FIG. 3), the locking plate 15 (see FIG. 3) is pivoted from the locking position to the unlocking position against the biasing force. When the release lever 60 is in its inoperative position as shown in FIG. 1, the pivoted end 60*a* of the lever 60 is placed at a right side with respect to a rotation center "O" of the worm wheel 58. Although not shown in the drawings, a known drive circuit is arranged for driving the motor 54. That is, when, with the drive circuit kept closed, the lid open switch 40 in the motor vehicle is manipulated, the motor 54 becomes energized to move the release lever 60 leftward in FIG. 1, that is, in the direction to pivot the locking plate 15 from the locking position to the unlocking position.

Figure 4:
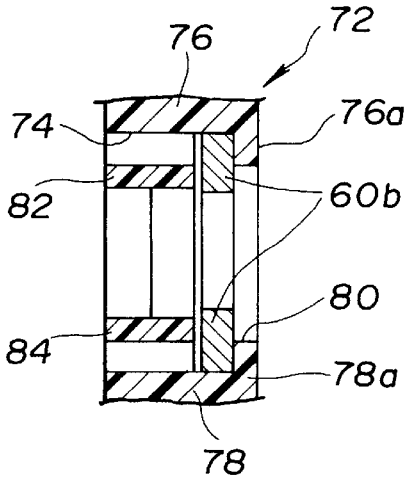
FIG. 4 is a sectional view taken along the line IV—IV of FIG. 1.

As is understood from FIGS. 1 and 4, the guide mechanism 70 comprises a guide structure 72 defined by the casing 52 of the power unlocking mechanism 50. The guide structure 72 functions to guide the fork-shaped end 60*b* of the release lever 60.

The guide structure 72 comprises a laterally extending groove 74 which is defined by upper and lower walls 76 and 78 for slidably receiving therein the fork-shaped end 60*b* of the release lever 60. The upper and lower walls 76 and 78 have respective flanges 76*a* and 78*a* which extend toward each other to leave a laterally extending window 80 through which the fork-shaped end 60*b* is partially viewed from the outside. Within the laterally extending groove 74, there extend in parallel a pair of ridges 82 and 84 each having a top against which the fork-shaped end 60*b* slidably abuts.

As is seen from FIG. 1, each flange 76*a* or 78*a* of the upper or lower wall 76 or 78 is formed with a slit 76*b* or 78*b*. With this slit 76*b* or 78*b*, one end portion 76*c* or 78*c* of the wall 76 or 78 has a less rigidity than the remaining part of the wall 76 or 78. That is, the end portion 76*c* or 78*c* is more flexible than the remaining portion.

Referring to FIG. 1, a return spring (not shown) is associated with the worm wheel 58 to bias the same in a backward direction. That is, when, due to manipulation of an after-mentioned cancel switch device 90 (or anti-theft device), the drive circuit becomes open, the return spring forces the worm wheel 58 to turn in the backward direction. However, if desired, in place of the return spring, a timer may be used. That is, in this case, upon expiration of a set time, the motor 54 is forced to turn in a reversed direction. Furthermore, if desired, a latch sensor may be used. That is, in this case, upon sensing the latch plate 14 being released from the locking plate 15, the motor 54 is forced to turn in a reversed direction.

Figure 5:
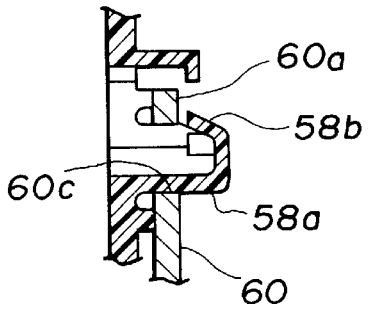
FIG. 5 is a sectional view taken along the line V—V of FIG. 1.

As is understood from FIGS. 1 and 5, the other end 60*a* of the release lever 60 is formed with an opening 60*c* into which a pivot stub 58*a* integrally formed on the worm wheel 58 is rotatably received. The pivot stub 58*a* has a resiliently deformable tongue 58*b*. Upon insertion of the pivot stub 58*a* into the opening 60*c*, the tongue 58*b* is resiliently compressed to permit the insertion, and once the insertion is accomplished, the tongue 58*b* is resiliently returned to its non-stressed position thereby to suppress disengagement of the stub 58*a* from the opening 60*c*. That is, engagement between the stub 58*a* and the opening 60*c* can be carried out in a so-called one touch manner.

As is seen from FIG. 6, a cancel switch device 90 (or anti-theft device) is further arranged on the casing 52 of the power unlocking mechanism 50, which, when manipulated "ON", opens the drive circuit of the motor 54 irrespective of operation of the lid open switch 40 in the motor vehicle.

Figure 7:
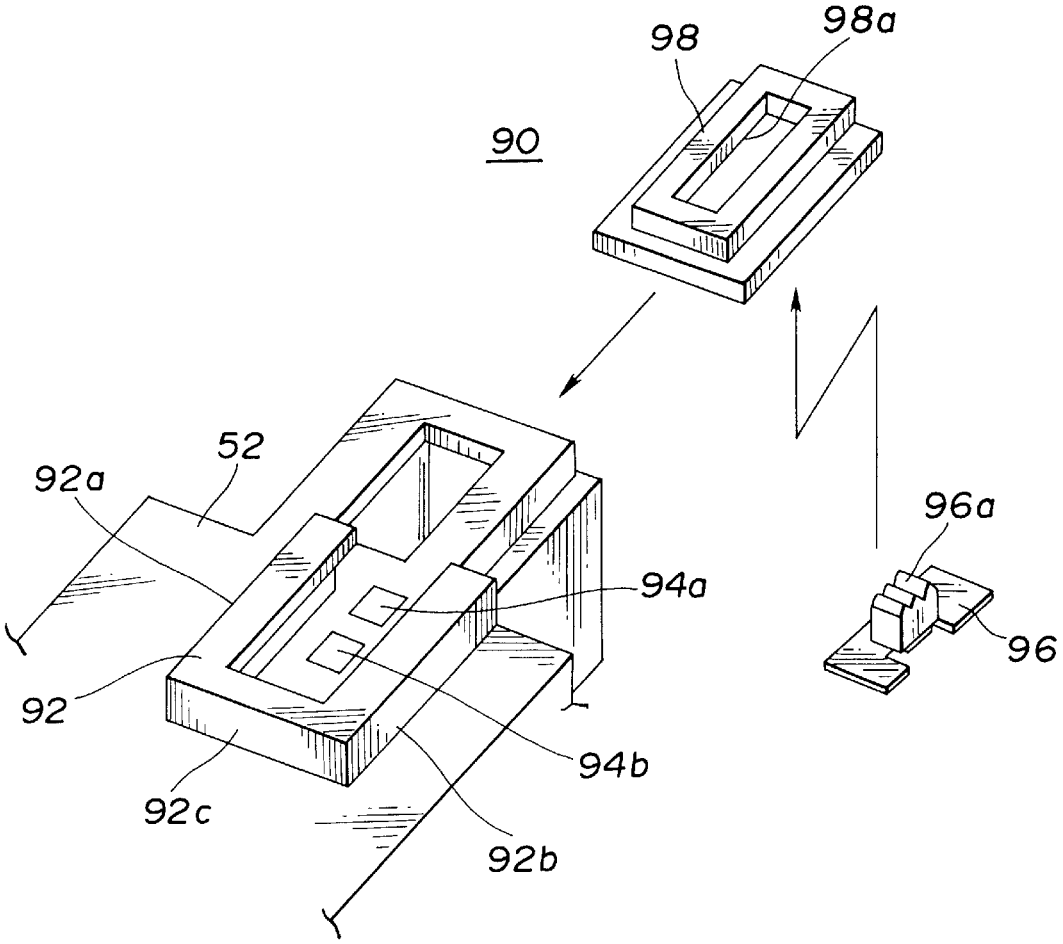
FIG. 7 is an exploded view of the cancel switch device.

As is well shown in FIG. 7, the cancel switch device 90 comprises a grooved structure 92 formed on the casing 52. The groove of the structure 92 is defined by three flanged walls 98*a*, 92*b* and 92*c*, as shown.

Two electrically conductive pieces 94*a* and 94*b* are disposed on the casing 52 at a portion enclosed by the grooved structure 92, which serve as contact points of the switch device 90. These contact points 94*a* and 94*b* are arranged in a power line which extends between the drive circuit of the motor 54 and a power source (that is, battery). That is, one point 94*a* is connected to the drive circuit and the other point 94*b* is connected to the power source.

Slidably installed within the grooved structure 92 is an electrically conductive plate 96 which serves as a switch lever of the switch device 90. The switch lever 96 has a plastic projection 96*a* connected thereto. The projection 96*a* has a corrugated top, as shown.

The switch lever 96 slides in the groove between "CANCEL-OFF" position (or anti-theft "OFF" position) wherein the switch lever 96 contacts to both the two contact points 94*a* and 94*b* and "CANCEL-ON" position (or anti-theft "ON" position) wherein the switch lever 96 contacts to only one contact point 94*a* or 94*b*.

It is thus to be noted that when the switch lever 96 takes "CANCEL-OFF" position, the two contact points 94*a* and 94*b* are connected causing "ON" condition of a switch proper, while, when the switch lever 96 takes "CANCEL-ON" position, the two contact points 94*a* and 94*b* are not connected causing "OFF" condition of the switch proper.

Snugly mated with the grooved structure 92 is a guide frame 98 which has at its raised center portion an elongate slot 98*a* through which the projection 96*a* of the switch lever 96 is projected to the outside. Thus, the sliding movement of the switch lever 96 is restricted by the elongate slot 98*a*.

In the following, operation of the lid lock device 10A of the first embodiment will be described with reference to the drawings.

Figure 9:
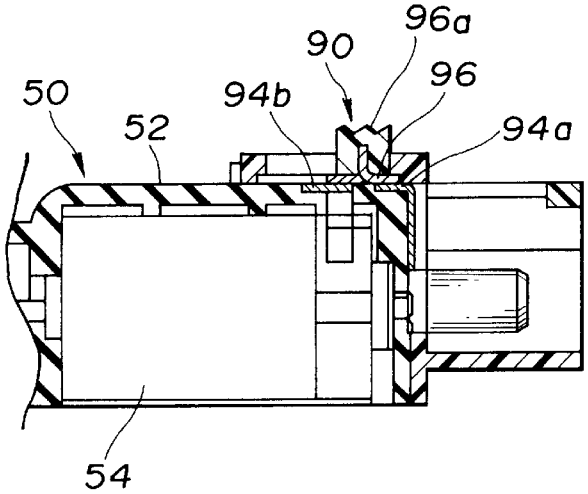
FIG. 9 is a view similar to FIG. 8, but showing "CANCEL-OFF" condition of the cancel switch device.

For ease of understanding, the description will be commenced with respect to a closed condition of the trunk lid 102 as shown in FIG. 2 and the switch lever 96 of the cancel switch device 90 assumes "CANCEL-OFF" position as shown in FIG. 9, that is, the anti-theft device is in its inoperative condition.

Under this condition, the automotive lid lock device 10A assumes the position as shown in FIG. 3, wherein the latch plate 14 is in the latching position and the locking plate 15 is in the locking position.

When now the lid open switch 40 is manipulated, the drive circuit of the power unlocking mechanism 50 energizes the electric motor 54 to pivot the locking plate 15 to the unlocking position. Upon this, the latch plate 14 is pivoted to the unlatching position due the biasing force constantly applied thereto, and thus the latch plate 14 releases the striker fixed to the vehicle body. Thus, the trunk lid is permitted to lift or open. When the locking plate 15 comes to the unlocking position, the drive circuit stops the energization of the motor 54. The unlocking position of the locking plate 15 is sensed by a position sensor "S" which is shown in FIG. 3.

When now the trunk lid 102 is pushed downward with a certain force, the striker secured to the vehicle body rushes into the striker receiving recess 13*a* of the lock device 10A and becomes engaged with the latch plate 14. Upon this, the latch plate 14 is pivoted to the latching position and the locking plate 15 is pivoted to the locking position due to the biasing force constantly applied thereto moving the release lever 60 leftward in FIG. 3 while rotating the worm wheel 58 to its original position. With this, the trunk lid 102 assumes the closed position and the lid lock device 10A assumes the condition as shown in FIG. 3.

When now the key cylinder 104 (see FIG. 2) is turned in a given direction by a key from the outside of the vehicle, the canceling arm 22 (see FIG. 3) forces the locking plate 15 to pivot from the locking position to the unlocking position. With this, the latch plate 14 is pivoted to the unlatching position thereby to release the striker, which permits opening of the trunk lid 102. When then the trunk lid 102 is pushed downward, the lid 102 is brought to the closed position by taking substantially the same operation manner as has been described hereinabove.

Figure 8:
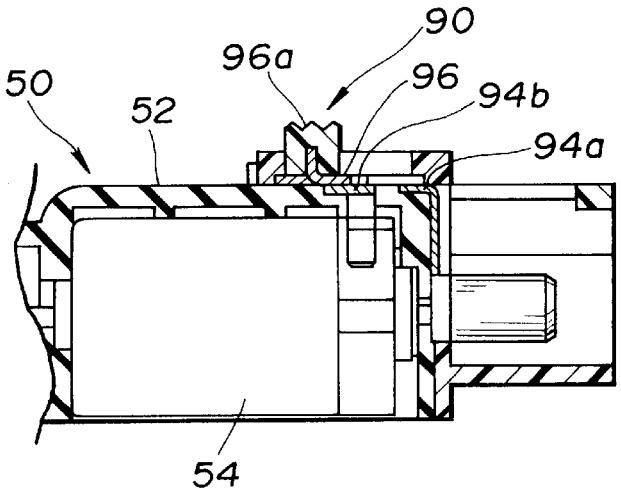
FIG. 8 is a sectional view taken along the line VIII—VIII of FIG. 6, showing "CANCEL-ON" condition of the cancel switch device.

It is now to be noted that once the switch lever 96 of the cancel switch device 90 is shifted to "CANCEL-ON" position as shown in FIG. 8, the manipulation of the lid open switch 40 becomes incapacitated. That is, under such condition, the power line between the drive circuit and the motor 54 is open. Thus, even if the lid open switch 40 is manipulated, the motor 54 is not energized and thus the locking plate 15 is not pivoted to the unlocking position. That is, the trunk lid 102 can not be opened.

Opening of the trunk lid 102 under such condition is only permitted when the key cylinder 104 mounted on the trunk lid 102 is turned by a key from the outside.

In the following, advantages of the lid lock device 10A of the first embodiment will be described.

Since the power unlocking mechanism 50 is compactly mounted on the upper portion of the lock proper 12, the entire construction of the lid lock device 10A can be made compact in size. That is, in this first embodiment, the release lever 60 is arranged on a rearward part of a way along which the release lever 60 travels and constructed to push the locking plate 15 when releasing of the striker from the latch plate 14 is carried out. This arrangement is different from that of the above-mentioned Japanese Publication 59-65165 and brings about a reduction in size of the lid lock device 10A in the traveling direction of the locking plate 15.

For providing the power unlocking mechanism 50 with "CANCEL-ON" and "CANCEL-OFF" conditions, there is no need of using a key. That is, in the invention, such conditions can be provided by handling the switch lever 96 of the cancel switch device 90. Furthermore, the "CANCEL-ON" and "CANCEL-OFF" conditions are indicated by the projection 96*a* of the switch lever 96 of the cancel switch device 90, which is viewed from the outside when the trunk lid 102 is open. That is, the "CANCEL-ON" and "CANCEL-OFF" conditions are easily recognized, which can assure the cancel operation of the power unlocking mechanism 50.

As will be understood from FIG. 3, when the canceling arm 22 is pivoted counterclockwise due to manipulation of the key cylinder 104, the locking plate 15 is pivoted to the unlocking position without pulling the release lever 60 rightward. Thus, the manipulation of the key cylinder 104 is carried out with a relatively small operation force.

Since the pivot stub 58*a* to which the release lever 60 is pivotally connected is integrally formed on the worm wheel 58, there is no need of using a separate pivot member.

The guide structure 72 (see FIG. 4) for the fork-shaped end 60*b* of the release lever 60 has a simple construction wherein the ridges 82 and 84 are exposed to the outside through the laterally extending window 80. Thus, the guide structure 72 can be molded by using a relatively simple molding technique.

As is seen from FIG. 1, when the release lever 60 is in its inoperative position, the pivoted end 60*a* of the lever 60 is positioned at a right side with respect to the rotation center "O" of the worm wheel 58. Thus, when the worm wheel 58 starts to rotate clockwise, a sufficient force is applied to the release lever 60 in the traveling direction of the same, which assures the pivoting of the locking plate 15 to the unlocking position.

Figure 11:
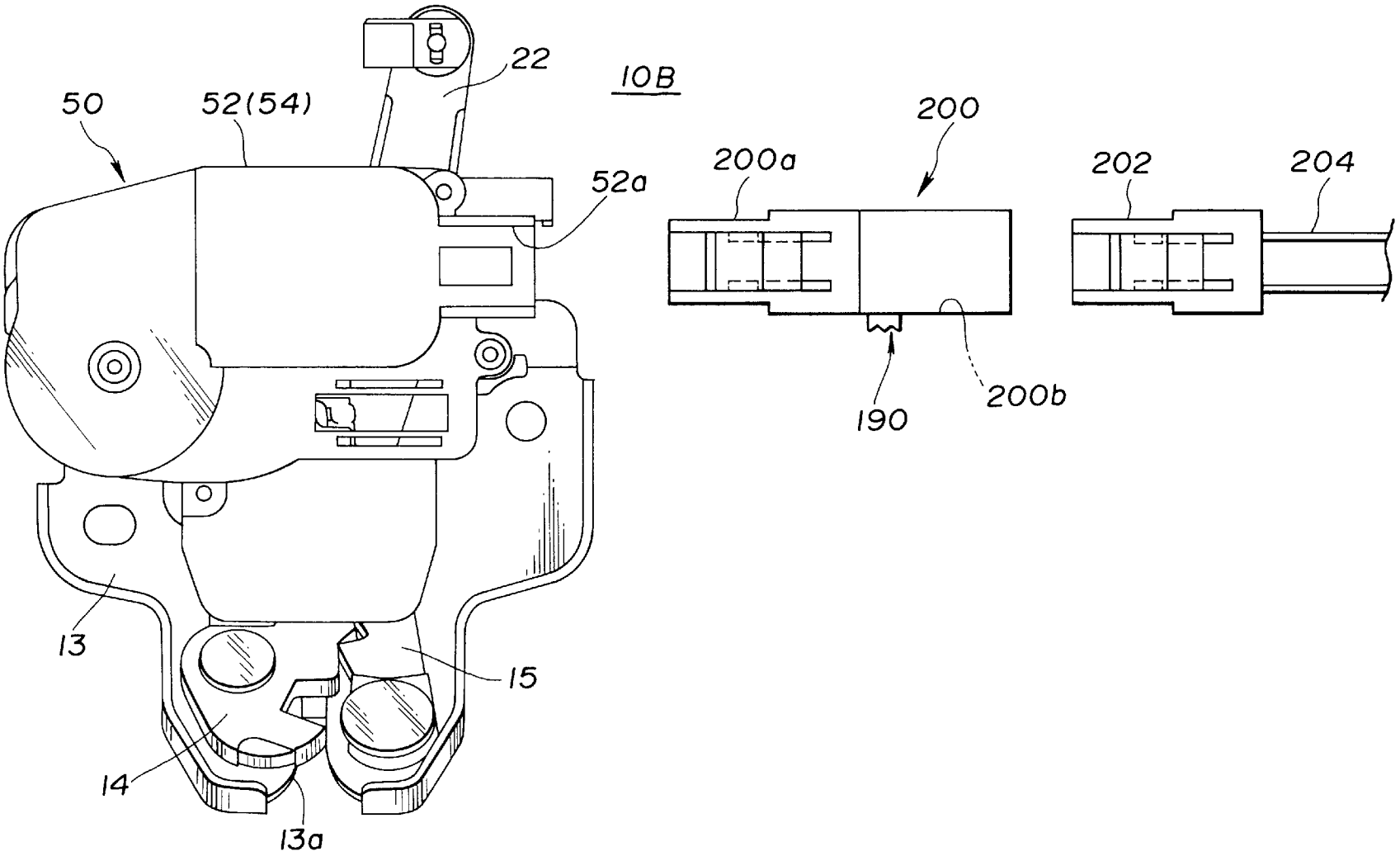
FIG. 11 is a view similar to FIG. 10, but showing a second embodiment of the present invention with a cancel switch device employed therein.
Figure 12:
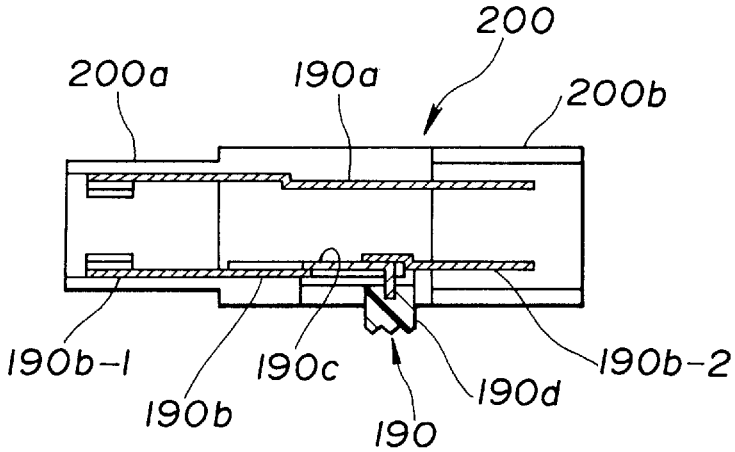
FIG. 12 is a sectional view of the cancel switch of the second embodiment, showing "CANCEL-OFF" condition of the cancel switch device.
Figure 13:
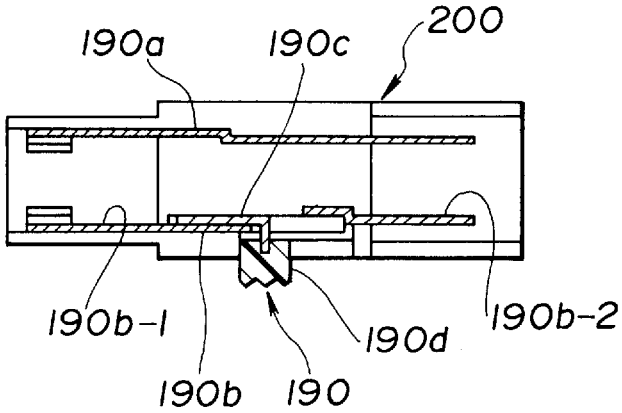
FIG. 13 is a view similar to FIG. 12, but showing "CANCEL-ON" condition of the cancel switch device.

Referring to FIGS. 11 to 13 of the drawings, there is shown an automotive lid lock device 10B of a second embodiment of the present invention.

Since the lid lock device 10B of this second embodiment is similar to the lid lock device 10A of the above-mentioned first embodiment, only parts and portions which are different from those of the first embodiment will be described in detail in the following.

In the second embodiment, a cancel switch device 190 is arranged on a connector 200 through which a plug member 202 of a power supply cable 204 is connectable to the power unlocking mechanism 50 of the lid lock device 10B. More specifically, the power supply cable 204 is arranged to connect the drive circuit of the motor 54 and a power source (viz., battery). Thus, when manipulated "ON"the cancel switch device 190 opens the drive circuit of the motor 54 irrespective of operation of the lid open switch 40 in the motor vehicle.

The connector 200 has a male portion 200*a* which is detachably mated with a female portion 52*a* defined by the casing 52 of the power unlocking mechanism 50. The connector 200 has further a female portion 200*b* with which the plug member 202 of the power supply cable 204 is detachably mated.

As is shown in FIG. 12, the cancel switch device 190 comprises two electrically conductive elongate plates 190*a* and 190*b* which are stationarily installed in the connector 200. One end portions of the elongate plates 190*a* and 190*b* are located in the male portion 200*a*, and the other end portions of the plates 190*a* and 190*b* are located in the female portion 200*b*. Thus, upon coupling of the connector 200 with both the casing 52 and the plug member 202, the one end portions are electrically connected to the power unlocking mechanism 50, and the other end portions are electrically connected to the power source.

As shown, one conductive elongate plate 190*b* consists of two aligned separate pieces 190*b*-1 and 190*b*-2. A switch lever 190*c*is movably received in the connector 200 in a manner to selectively connect and disconnect the two separate pieces 190*b*-1 and 190*b*-2. The switch lever 190*c* has a plastic projection 190*d* connected thereto. The projection 190*d* has a corrugated top, as shown.

The switch lever 190*c* slides in the connector 200 between "CANCEL-OFF" position wherein the switch lever 190*c* connects the two separate pieces 190*b*-1 and 190*b*-2 and "CANCEL-ON" position wherein the switch lever 190*c* disconnects the two separate pieces 190*b*-1 and 190*b*-2. Thus, it is to be noted that when the switch lever 190*c* takes "CANCEL-OFF" position, the two separate pieces 190*b*-1 and 190*b*-2 are connected causing "ON" condition of a switch proper, while, when the switch lever 190*c* takes "CANCEL-ON" position, the two separate pieces are not connected causing "OFF" condition of the switch proper.

Like in the first embodiment 10A, the "CANCEL-ON" and "CANCEL-OFF" conditions are indicated by the projection 190*d* of the switch lever 190*c* of the cancel switch device 190, which is viewed from the outside when the trunk lid 102 is open. That is, such ON and OFF conditions are easily recognized, which can assure the cancel operation of the power unlocking mechanism 50.

Although the foregoing description is directed to an arrangement wherein the cancel switch device 90 or 190 is connected to the trunk lid 102 (more specifically, to the lid lock device mounted to the trunk lid), the cancel switch device may be connected to a wall of the trunk room.

What is claimed is:

1. An automotive lid lock device comprising:

a lock including a latch plate and a locking plate, said locking plate being pivotal between a locking position to lock the latch plate and an unlocking position to release the latch plate; and a power unlocking mechanism for pivoting said locking plate to said unlocking position using electric power, said power unlocking mechanism including:

an electric motor;

a worm connected to an output shaft of said motor to rotate therewith;

a worm wheel operatively engaged with said worm; and a release lever extending over said latch plate and between said locking plate and said worm wheel, and having a first end engaged with an end of said locking plate and a second end pivotally connected to said worm wheel, wherein, when said worm wheel is turned in a direction, said worm wheel pushes said release lever toward said locking plate to pivot said locking plate from said locking position toward said unlocking position, and wherein said release lever is guided by a guide structure to permit movement thereof toward said locking plate.

2. An automotive lid lock device as claimed in claim 1, wherein an end of said locking plate is pushed by a first end of said release lever when said worm wheel is turned in said direction.

3. An automotive lid lock device as claimed in claim 2, wherein said end of said locking plate is bent at a substantially right angle to form a bend head.

4. An automotive lid lock device as claimed in claim 1, wherein said lock further comprises a base with a striker receiving recess, and said latch plate and said locking plate are arranged at opposite positions with respect to the striker receiving recess.

5. An automotive lid lock device as claimed in claim 4, further comprising a pivotal canceling arm engaged with said locking plate, said canceling arm pivoting said locking plate from said locking position to said unlocking position when pivoted in a predetermined direction.

6. An automotive lid lock device as claimed in claim 5, wherein said worm and said worm wheel are positioned above said latch plate and said canceling arm is positioned above said locking plate.

7. An automotive lid lock device as claimed in claim 6, wherein said electric motor is positioned above said striker receiving recess.

8. An automotive lid lock device as claimed in claim 1, wherein said power unlocking mechanism further includes an anti-theft mechanism which operatively disconnects a drive circuit of said motor from a power source when actuated.

9. An automotive lid lock device as claimed in claim 8, wherein said anti-theft mechanism comprises:

first and second spaced contact points, the first spaced contact point being connected to said drive circuit and the second spaced contact point being connected to said power source; and a switch lever movable between an anti-theft "ON" position wherein said switch lever operatively disconnects the first and second contact points, and an anti-theft "OFF" position wherein said switch lever operatively connects the first and second contact points.

10. An automotive lid lock device as claimed in claim 9, wherein said first and second spaced contact points and said switch lever are arranged on a casing of said power unlocking mechanism.

11. An automotive lid lock device as claimed in claim 9, wherein said first and second spaced contact points and said switch lever are arranged on a connector which is detachably connected to a casing of said power unlocking mechanism, said connector supplying an electric power to said drive circuit from said power source.

12. An automotive lid lock device comprising:

a lock including a latch plate and a locking plate, said locking plate being pivotal between a locking position to lock the latch plate and an unlocking position to release the latch plate; and a power unlocking mechanism for pivoting said locking plate to said unlocking position using electric power, said power unlocking mechanism including:

an electric motor;

a worm connected to an output shaft of said motor to rotate therewith;

a worm wheel operatively engaged with said worm; and a release lever extending over said latch plate and between said locking plate and said worm wheel, wherein, when said worm wheel is turned in a direction, said worm wheel pushes said release lever toward said locking plate such that an end of said locking plate is pushed by a first end of said release lever to pivot said locking plate from said locking position toward said unlocking position, wherein said first end of said release lever is fork-shaped and guided by a guide structure defined by a casing of said power unlocking mechanism.

13. An automotive lid lock device as claimed in claim 12, wherein said guide structure comprises:

upper and lower walls defined by said casing for forming therebetween a laterally extending groove, said groove being sized and constructed to slidably receive therein the fork-shaped first end of said release lever; and a pair of ridges extending within said laterally extending groove, each ridge having a top against which the fork-shaped first end slidably abuts.

14. An automotive lid lock device as claimed in claim 13, wherein the upper and lower walls have respective flanges which extend toward each other to leave a laterally extending aperture.

15. An automotive lid lock device as claimed in claim 2, wherein each of the flanges of the upper and lower walls includes at least one slit.

* * * * *